US011116364B1

(12) United States Patent
Davis

(10) Patent No.: US 11,116,364 B1
(45) Date of Patent: Sep. 14, 2021

(54) GRAVITY BASED SOAP DISPENSER

(71) Applicant: Malcomb Davis, Long Beach, CA (US)

(72) Inventor: Malcomb Davis, Long Beach, CA (US)

(73) Assignee: Malcomb Davis, Long Beach, CA (US)

( * ) Notice: Subject to any disclaimer, the term of this patent is extended or adjusted under 35 U.S.C. 154(b) by 0 days.

(21) Appl. No.: 16/988,311

(22) Filed: Aug. 7, 2020

(51) Int. Cl.
*A47K 5/13* (2006.01)

(52) U.S. Cl.
CPC ..... *A47K 5/13* (2013.01)

(58) Field of Classification Search
CPC .. A01K 7/00; A47K 5/13; A47L 13/46; A47L 13/51
USPC ..... 222/166, 185.1, 22, 425; 15/244.1
See application file for complete search history.

(56) References Cited

U.S. PATENT DOCUMENTS 1,497,716 A * 6/1924 Fawcett ..... A47K 5/10 222/161
1,501,068 A * 7/1924 Schatz ..... F25D 3/08 222/67
1,973,709 A * 9/1934 Hibbert ..... A01J 13/00 366/176.3
2,176,988 A * 10/1939 Cameron ..... A47F 1/03 222/185.1
2,218,271 A * 10/1940 Sodeberg ..... A47K 5/02 248/213.2
2,425,251 A * 8/1947 Landau ..... B43M 11/04 118/267
2,594,176 A * 4/1952 Kaiser, Jr. ..... A47L 13/51 15/264
2,922,248 A * 1/1960 Kocsi ..... A47K 5/02 248/311.2
3,160,319 A * 12/1964 Lengsfeld ..... D06F 39/026 222/54
3,163,335 A * 12/1964 Chappell ..... G01F 11/262 222/455
3,542,261 A * 11/1970 Greenberg ..... B44D 3/121 222/576
3,720,184 A * 3/1973 Pearce ..... A01K 5/0225 119/51.5

(Continued)

OTHER PUBLICATIONS

"OXO Good Grips Soap Dispensing Sponge Holder", downloaded from https://www.kohls.com/product/prd-4016723/oxo-good-grips-soap-dispensing-sponge-holder.jsp on Aug. 7, 2020, 9 pages.

(Continued)

*Primary Examiner* — Paul R Durand
*Assistant Examiner* — Michael J. Melaragno
(74) *Attorney, Agent, or Firm* — Perkins Coie LLP; Jordan Becker

(57) ABSTRACT

Introduced here is a soap dispenser that uses gravitational force to dispense soap from a liquid soap bottle into a tray. The soap dispenser includes the tray and a socket. The socket is attached to the soap bottle socket, which is then securely held by an interlocking mechanism of the socket. The interlocking mechanism can be, for example, a threaded locking system. Once the soap bottle is secured by the socket, the soap dispenser and bottle are inverted together, such that the bottom surface of the tray is resting on a flat surface and the soap bottle is upside-down. The socket also includes an outlet that opens towards the tray. When inverted, the soap from the soap bottle is dispensed from the outlet into the tray.

18 Claims, 2 Drawing Sheets

(56) References Cited

U.S. PATENT DOCUMENTS 4,118,821 A * 10/1978 Kuhn ..... B23K 3/028 118/268
4,134,365 A * 1/1979 Futers ..... A01K 5/0225 119/51.5
4,180,430 A * 12/1979 Gelman ..... B43M 5/025 118/267
4,331,232 A * 5/1982 Larkin ..... A47K 5/03 206/565
4,573,434 A * 3/1986 Gardner ..... A01K 7/02 119/77
4,840,143 A * 6/1989 Simon ..... A01K 5/0225 119/52.1
4,993,546 A * 2/1991 Southard ..... A47K 1/08 206/77.1
5,165,365 A * 11/1992 Thompson ..... A01K 5/0142 119/61.53
5,228,601 A * 7/1993 Podesta ..... A47K 5/13 222/181.2
5,259,336 A * 11/1993 Clark ..... A01K 7/00 119/51.5
5,377,621 A * 1/1995 Camm ..... A01K 5/0114 119/61.54
5,590,817 A * 1/1997 Kaufman ..... A47K 5/122 222/185.1
5,680,929 A * 10/1997 Von Seidel ..... A47K 5/02 206/77.1
5,687,783 A * 11/1997 Finnegan ..... A01K 7/02 119/77
5,769,280 A * 6/1998 Ehresmann ..... A47G 23/0241 222/108
5,775,550 A * 7/1998 Toll ..... B67D 3/044 222/185.1
5,884,817 A * 3/1999 Kaufman ..... A47K 5/122 222/185.1
6,467,428 B1 * 10/2002 Andrisin ..... A01K 5/0114 119/51.5
6,964,535 B2 11/2005 Bell et al.
6,971,331 B1 * 12/2005 Rohrer ..... A01K 7/02 119/52.1
7,472,807 B1 * 1/2009 Black ..... B67D 3/0025 141/362
8,381,686 B2 * 2/2013 Spiegel ..... A01K 7/00 119/74
9,155,285 B2 * 10/2015 Li ..... A01K 7/00
9,220,391 B1 * 12/2015 Henninger ..... A47L 13/51
D751,774 S * 3/2016 Allen ..... D30/122
9,907,291 B2 * 3/2018 Lathim ..... A01K 5/0225
D846,815 S * 4/2019 Darkwah ..... D30/132
10,357,132 B1 * 7/2019 Martin ..... A47K 1/09
10,759,647 B1 * 9/2020 Fabozzi ..... B67D 3/0083
2004/0083646 A1 * 5/2004 Bielen ..... A01G 27/005 47/40.5
2005/0155983 A1 * 7/2005 Robinson ..... B67D 3/0029 222/143
2009/0194138 A1 * 8/2009 Burns ..... B08B 1/007 134/59
2010/0213215 A1 * 8/2010 Laible ..... B67D 7/36 222/185.1
2011/0283947 A1 * 11/2011 Linke ..... A01K 7/00 119/61.53
2011/0283948 A1 * 11/2011 Wong ..... A01K 7/00 119/74
2012/0125263 A1 * 5/2012 Northrop ..... A01K 5/0114 119/52.1
2013/0056496 A1 * 3/2013 Coleman ..... A47L 17/00 222/185.1
2015/0122185 A1 * 5/2015 Lucky ..... A01K 7/04 119/51.5
2017/0215375 A1 * 8/2017 McKay ..... A01K 7/00

OTHER PUBLICATIONS

"The Genius Universal Bottle Attachment Lets You Get the Last Bits of Any Bottle", downloaded from https://odditymall.com/flip-it-bottle-emptier on Aug. 7, 2020, 6 pages.
"The Original Bigfoot Bottle Inversion Cap", downloaded from https://www.amazon.com/Original-Bigfoot-Bottle-Inversion-Cap/dp/B00ACTOITI/ref=cm_cr_arp_d_product_top?ie=UTF8 on Aug. 7, 2020, 5 pages.

* cited by examiner

GRAVITY BASED SOAP DISPENSER

TECHNICAL FIELD

The disclosed teachings relate to a soap dispenser. More specifically, the disclosed teachings relate to a soap dispenser configured to dispense soap into a tray using gravitational force.

BACKGROUND

Touchless soap dispensers are common in public areas. The primary purpose of touchless soap dispensers is to limit the spread of germs resting on high contact surfaces. For example, a soap dispenser that requires push or pull activation must be touched by every user. On the other hand, a touchless soap dispenser, such as one that is motion activated, does not require contact with the soap dispenser.

In private settings, such as in a person's home, touchless soap dispensers are much less common. For example, in a person's home bathroom and kitchen, the soap dispensers require human contact. In some cases, rather than using hand-based methods, some people rely on other options for cleaning inside one's home. A dishwasher, for example, is a common alternative to hand washing dishes in one's home. However, 60% of Americans that have dishwashers still hand wash their dishes until the dishes are completely clean or at least do a "pre-wash" prior to placing them in the dishwasher.

BRIEF DESCRIPTION OF THE DRAWINGS

The techniques introduced here may be better understood by referring to the following Detailed Description in conjunction with the accompanying drawings, in which like reference numerals indicate identical or functionally similar elements.

DETAILED DESCRIPTION

Figure 1:
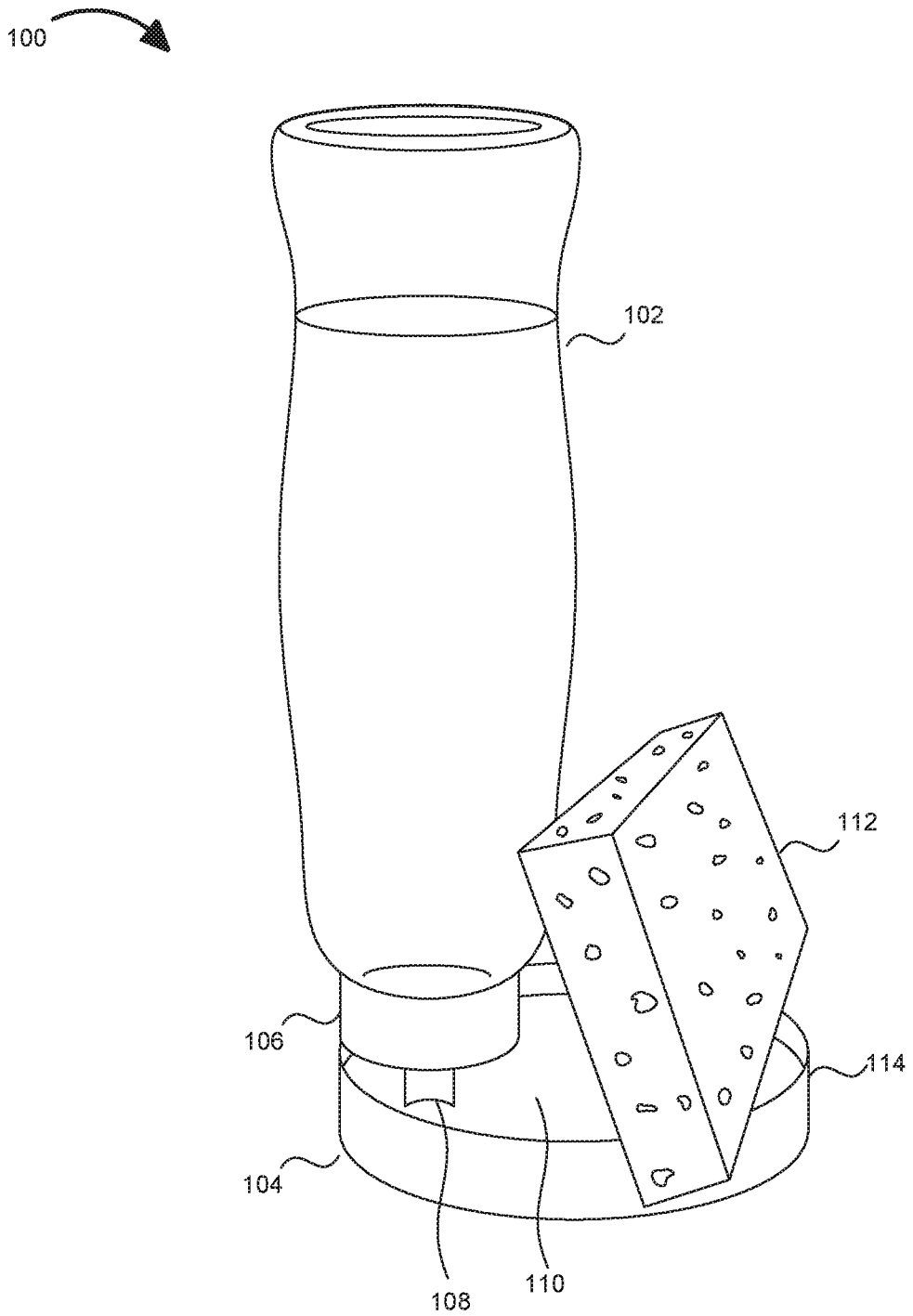
FIG. 1 depicts a liquid soap dispenser with a soap bottle and sponge.

Soap dispensers are a common item in households and public areas. A soap dispenser is a device that, when manipulated or triggered, dispenses soap in a small or single use quantity. Conventional soap dispensers can be manually operated, such as by a handle, or can be automatic. Automatic soap dispensers are generally hands-free and battery-operated. The design enables dispensing based on detected motion, timing, or other signals.

Dish soap, which is predominantly found in kitchens, is also referred to as dishwashing liquid, dishwashing soap, and dish detergent. Dish soap is usually a highly-foaming mixture of surfactants with low skin irritation qualities. It is primarily used for hand washing of dishes such as plates, cutlery, cooking utensils, and the like. Moreover, dish soap dispensers tend to be high-contact because the soap is usually dispensed though a squeeze-bottle or low flow bottle.

As such, hands-free technology is not as common in dish soap dispensers as in other settings (e.g., public bathrooms). The lack of progress in dish soap dispensing has caused many issues. For example, germs can be spread easily due to the high-contact nature of dispensing dish soap. A person has to grab the dish soap bottle every time dish soap needs to be dispensed onto a sponge or dish for washing. A family of four, for example, may have multiple dishes after a family meal. The person who washes the dishes might have to touch the bottle multiple times to replenish the dish soap on the sponge while washing the dishes. As such, the person's germs will reside on the surface of the bottle and may contaminate the next person to touch the bottle.

Additionally, dish soap is often wasted because the user does not have enough control over how much dish soap is dispensed. For example, a user may have a squeeze-bottle to dispense dish soap. The user may have only one plate to wash, but when they squeeze the bottle, more than needed is dispensed. Further, conventional soap dispensers do not use space efficiently. Dish soap is commonly sold in a bottle and a user also needs a sponge or similar item to use the dish soap. Thus, trays are sold to hold both the bottle and the sponge. The trays are usually rectangularly shaped and have enough space for both the bottle and a sponge. Thus, the user needs a separate holder and counter space to place both the dish soap bottle and the sponge.

The embodiments introduced here overcome these drawbacks with a liquid soap dispenser that is configured to connect to (interlock with) a bottle and dispense soap into a tray using gravity. The embodiments make it possible to enable any of a wide variety of dish soap bottles to become touch-less dispensers. In particular, the disclosed embodiments include a liquid soap dispenser with a well containing a reservoir of liquid dish soap, a socket sized to match the size of most dish soap bottles on the market today (e.g., a threaded socket) for interlocking with the neck of a dish soap bottle, and an outlet for dispensing dish soap from the dish soap bottle into the well. To use the liquid soap dispenser, a user can, for example, remove the screw-on cap from a dish soap bottle, thread the socket of the liquid soap dispenser onto the bottle, and subsequently, invert the liquid soap dispenser. Once inverted, the soap is dispensed into the well through the outlet until the level of the dish soap in the well is above the outlet. Thus, covering any pockets of air between the level of the dish soap and the outlet. A user can then use a sponge, wand, or their hands to blot the dish soap in the well, as needed. As the dish soap is used and an air gap is formed between the soap line and the outlet, more soap will be released into the well through the outlet.

Liquid Soap Dispenser

FIG. 1 depicts a liquid soap dispenser 100 with a soap bottle and sponge.

Liquid soap dispenser 100 includes dish soap bottle 102, base 104, socket 106, outlet 108, well 110, sponge 112, and ridge 114. Liquid soap dispenser 100 can be various sizes and shapes. For example, in an industrial kitchen setting, the liquid soap dispenser 100 can be larger to accommodate the higher usage rate. In a household setting, it can be smaller to accommodate for family use. Liquid soap dispenser 100 can also be made of various materials such as plastic, stainless steel, ceramic, or any combination of these and/or other materials.

Dish soap bottle 102 can be any commonly available off-the-shelf bottle that holds dish soap. For example, liquid dish soap commonly comes in bottles of various shapes and sizes based on the brand and capacity. For instance, a dish soap bottle that is meant for industrial use will be larger than one that is meant for household use. However, most commonly available liquid dish soap bottles have essentially the same size of neck, upon which a cap is screwed on. The base 104 can be placed on a surface such as countertop near the sink. Base 104 can be various shapes such as circular, rectangular, square, or octagonal. Base 104 can include one or more fasteners that firmly connect the liquid soap dispenser 100 to a counter top. For example, the bottom of the base 104 can include one or more suction cups and/or adhesives.

In another example, the base 104 can be heavily weighted. The base 104 can be, for instance, made of a heavier material (e.g., ceramic) than the other portions of liquid soap dispenser 100. In some embodiments, portions of the base 104 can be weighted differently in order to counterbalance the weight of the dish soap bottle 102. For example, the portion of the base 104 farthest from the socket 106 can be heavier than the rest of the base 104. Thus, when the dish soap bottle 102 is inserted, the liquid soap dispenser 100 will not tip over.

Socket 106 is coupled to base 104. In this context the phrase "coupled to" is intended to encompass embodiments in which the socket 106 is made as an integral part of (e.g., from the same piece of material as) the base 104, though it can alternatively be removably attachable to the base 104, or permanently attached to the base after the socket 106 is made. Socket 106 can be a simple hollow cylinder, the interior surface of which is sized to accommodate the neck of most commonly available dish soap bottles, and which is threaded to match the threading on those bottle necks. In some embodiments socket 106 can be angled slightly downwards toward the center or of the base 104. This can help stabilize the liquid soap dispenser 100 when the dish soap bottle 102 is inserted. The angled socket 106 can shift the center of mass towards the middle of the liquid soap dispenser 100, and thus, prevent the soap try 100 from tipping over. In some embodiments, the socket 106 interlocks with the dish soap bottle 102. The socket 106 can interlock with the dish soap bottle 102 using any of various interlocking mechanisms. For example, socket 102 can have a threaded locking mechanism to interlock with the bottle. In other embodiments, socket 106 can have a clamp attached to it that can grasp the dish soap bottle 102.

In some embodiments, the liquid soap dispenser 100 can be modular. For example, the socket 106 can be removed and replaced in order to interlock with the top of dish soap bottle 102. The base 104 may be designed to accommodate a socket having any of multiple different bottle attachment configurations, which can be removable and replaceable. If the soap dish bottle 102 has a threaded top, then a socket 106 with threads can be coupled to the base 104. Alternatively, if the dish soap bottle 106 has a snap-fit cap, then the socket 106 with a clamp can be coupled to the base 104. In another example, if the liquid soap dispenser 100 is used for large-scale cleaning tasks, then a base 104 with a large surface area can be coupled to a socket 106.

In some embodiments, the parts of the liquid soap dispenser 100 can be coupled together using any of various of coupling mechanisms. For example, the coupling mechanism can be a snap-fit mechanism, friction-based mechanism, screw mechanism, adhesive-based mechanism, or other appropriate mechanism. For instance, the base 104 can have a female connector(s) that receives the male connector(s) on a socket 106. In another example, the liquid soap dispenser 100 can couple to add-on features in a similar manner. The add-on features can be, for example, suction cups, a brush holder, or an extra tray.

The outlet (opening) 108 allows the liquid dish soap to drain from the dish soap bottle 102 into the well 110. In some embodiments, the outlet 108 can be an opening at the bottom of socket 106. For example, the socket 106 can be substantially circular and the outlet 108 can also be substantially circular with a smaller diameter than the diameter of socket 106. The well 110 houses the soap that is dispensed from the outlet 108. The well 110 is formed in part by a ridge 114 (e.g., a wall) surrounding the periphery of the base 104. In some embodiments, the outlet 108 is closer to the top surface of the base 104 than to the top of the ridge 114 surrounding the well 110. Thus, when the amount of soap in the well 110 rises above the outlet 108, more soap will not be dispensed from the outlet 108. Conversely, when the amount of soap in the well 110 falls below the outlet 108, more soap will be dispensed.

In some embodiments, a portion of the top surface of the well 110 can include a raised surface that is higher than the rest of the top surface of the well 110. The raised surface can help a user control the amount of soap that is blotted onto a sponge. For example, the raised surface can be a square in the middle of the well 110 that rises to just below the maximum height of the ridge 114 that surrounds the well 110. Thus, a user can blot a sponge on the raised surface to get a small amount of soap on the sponge. Alternatively, the user can blot the sponge into the well 110 to get more soap.

In some embodiments, the liquid soap dispenser 100 includes a holding mechanism for the sponge 112. For example, the holding mechanism can be two notches that are colinear on the ridge 114 that surrounds the well 110. One side of the sponge can be rested within the notches while the opposite side is rested against the dish soap bottle 102. In some embodiments, the ridge 114 can include a flat portion that the sponge 112 can be rested on.

Figure 2:
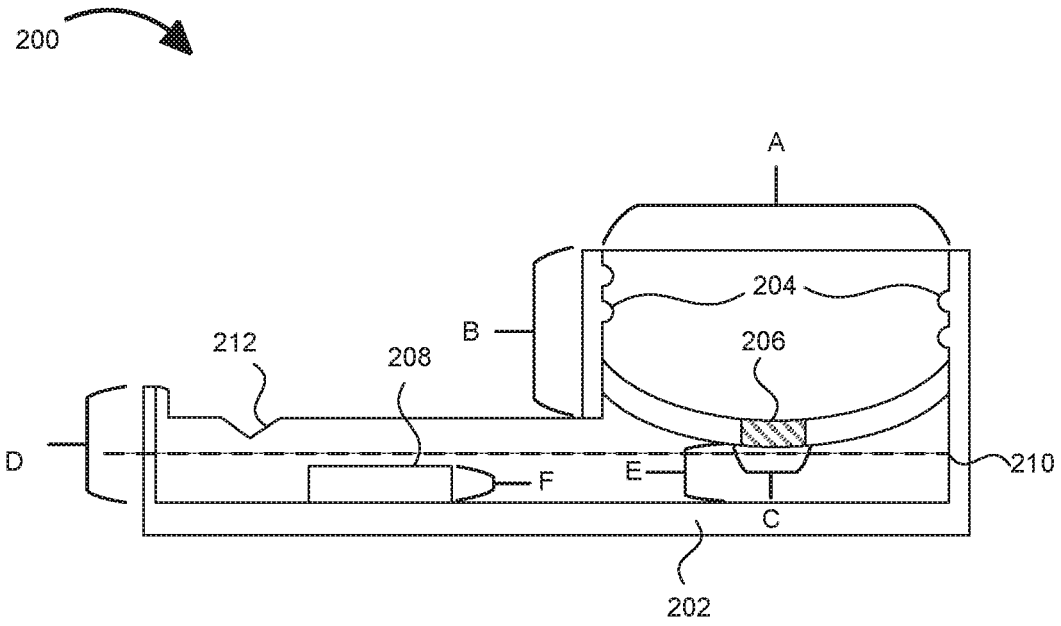
FIG. 2 is a cross-sectional view of a liquid soap dispenser viewed from one side.

FIG. 2 is a cross-sectional view 200 of a liquid soap dispenser from one side. Cross-sectional view 200 includes base 202, threading 204, outlet 206, raised surface 208, soap line 210, and notch 212. Cross-sectional view 200 also includes dimensions A, B, C, D, E and F for various elements within cross-section view 200. The base 202 is similar to base 104 described in conjunction with FIG. 1. Threading 204 interlocks with a top of a dish soap bottle. For example, a user can remove the cap from a dish soap bottle, and thread the liquid soap dispenser using the threading 204 to the dish soap bottle. After the bottle is securely threaded, the user can invert the liquid soap dispenser and bottle such that the base 202 is resting on a surface.

The outlet 206 releases the soap from a bottle into a well formed by the base 202. In some embodiments, the outlet 206 is an opening below the threading 204. In some embodiments, the outlet 206 is a funnel that stretches from near the threading 204 to the base 202. Raised surface 208 in the illustrated embodiment is a flat protrusion that rises from the base 202 to below the soap line 210. In some embodiments, the raised surface 208 helps a user blot a small amount of soap. For instance, the soap line 210 can be an inch above the base 202. A user's sponge can be half an inch thick. Thus, the user likely would not want to submerge the entire sponge into the soap. In such a situation, the user can blot the sponge on the raised surface 208.

In some embodiments, the soap line 210 can rise above the outlet 206. When the soap line 210 is above the outlet 206, soap may not be dispensed from the outlet 206. If the soap line 210 is lower than the outlet 206, there is air between the two. Thus, in order to fill the air gap, soap will automatically be dispensed, by gravity, into the well from the outlet 206. In some embodiments, the outlet 206 can be made of a buoyant and flexible material that opens, and closes based on its current position. For example, when the soap line 210 is at or above the outlet 206, the material may curve upwards away from the base 202 due to the force exerted by the soap. By doing so, the outlet 206 may substantially close. Conversely, when the soap line 210 is below the outlet 206, the material may curve downwards towards the base 202, causing the outlet 206 to open. The upward and downward movement thereby can control the dispensing of the dish soap.

Notch 212 is sized and shaped to support one side of a sponge (e.g., a long side of a rectangular sponge). In some embodiments, the notch 212 is on a ridge along the periphery of the base 202. A user can then place a sponge into the notch 212. In some embodiments, there are two notches that are colinear and located opposite each other on the ridge surrounding the base 202. Thus, the base 202 can support one side of a sponge in the two notches.

The dimensions of the liquid soap dispenser described herein can vary to accommodate for use with various bottles and for use in various environments. The dimensions of the liquid soap dispenser enable a commercially available bottle to be inserted into the socket of the liquid soap dispenser, allow the liquid soap to travel through outlet 206 into the well to submerge raised surface 208 without overflowing beyond the walls of the well. Conventionally, screw thread cap sizes are expressed as two numbers. The first number refers to a cap diameter (in millimeters) and the second number refers to the distance (in millimeters) from the top of the bottle to the first thread. Common screw thread cap sizes are 400, 410, 415, 425, and 430. For example, a screw thread cap of 400 represents a bottle with a cap diameter of 40 millimeters (mm) and 0 mm from the top of the bottle to the first thread. Moreover, conventional liquid soap bottles include various cap sizes depending, for example, on the type of cap (e.g., squeeze cap, removable cap, sports cap, or flip-top)

Dimension A represents the width between the two sides of threading 204 (e.g., width of socket 106). In order to accommodate many of the commercially available bottles and various bottle neck types (e.g., threaded or snap fit), dimension A can have a range between 0.3 inches to 5 inches. Dimension B represents the height of the socket (e.g., socket 106). In some embodiments, the socket receives most of the neck of the bottle. Accordingly, dimension B can be more than the distance between the top of the bottle to the first thread. For example, dimension B can range between 0.3 inches and 2 inches.

Dimension C represents the width of the outlet 206. Outlet 206 ensures a steady flow of soap into the well, while also avoiding a rush of soap into the well such that the soap overflows. In some embodiments, dimension C can have a proportional relationship to dimension A. For example, dimension A and dimension C can have a three to one relationship. For instance, when dimension A is 3 inches, dimension C is 1 inch. In some embodiments, dimension C can range between 0.1 inch to 0.5 inches.

Dimension D represents the depth of the well (e.g., well 110). In some embodiments, dimension D can be proportional to dimension B, where dimension D is half of dimension B. For example, if dimension B is 0.5 inches, dimension D is 0.25 inches. In some embodiments, dimension D is based on dimension E such that dimension D is greater than dimension E. Dimension E is the distance between the outlet 206 and bottom of the well. For example, if dimension E is one inch, dimension D can be greater than one inch.

Dimension F is the height of raised surface 208 measured from the bottom of the well. In some embodiments, dimension F is less than dimension D such that raised surface 208 is submerged under soap line 210. For example, if dimension D is one inch, dimension F can be less than one inch.

For example, a liquid soap dispenser can have a dimension A of 2 inches, dimension B of 0.4 inches, dimension C of 0.2 inches, dimension D of 0.4 inches, dimension E of 0.2 inches and dimension F of 0.1 inches. In one embodiment, dimension A is 1 inch, dimension B is 1 inch, dimension C is 0.2 inches, dimension D is 0.5 inches, dimension E is 0.3 inches, and dimension F is 0.2 inches. Accordingly, a bottle with a cap size of 1 inch can be inserted into the socket, allowing the soap inside the bottle to drain through outlet 206 and submerge raised surface 208, without overflowing.

Figure 3:
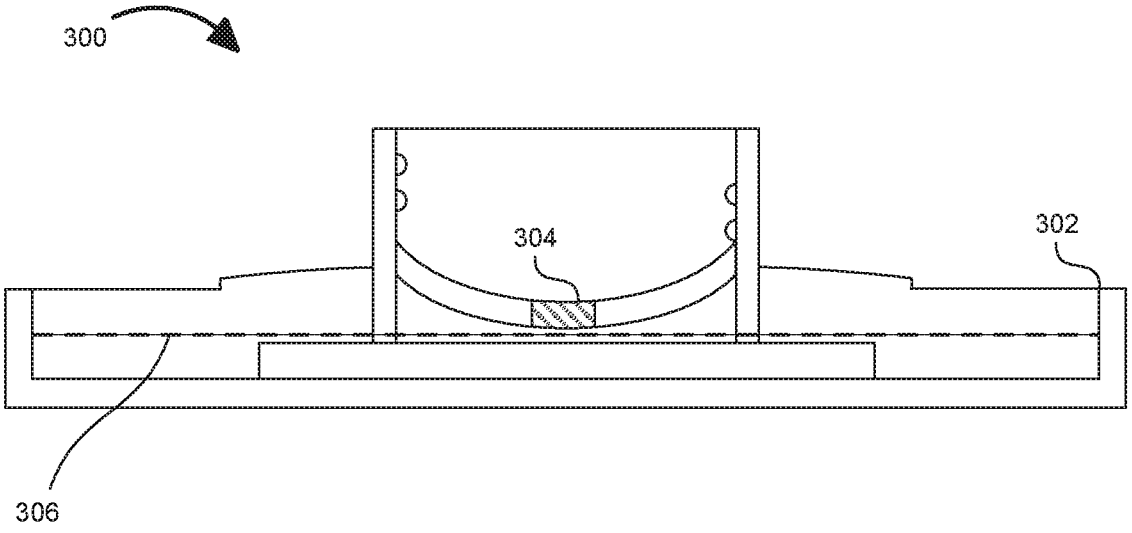
FIG. 3 is a cross-sectional view of a liquid soap dispenser viewed from the front.

FIG. 3 is a cross sectional view 300 of a liquid soap dispenser viewed from the front. Frontal view 300 includes ridge 302, opening 304, and soap line 306. The ridge 302 rises from the base and runs along the periphery of the base to form a well. The height of the ridge 302 can be based on where the opening 304 is located. For example, soap can flow from the opening 304 into the well when there is air between the opening 304 and soap line 306. If, however, there is no air between the opening 304 and soap line 306, soap may not be dispensed. Thus, ridge 302 can rise above the opening 304 such that soap line 306 can rise above the opening 304 to remove the air gap.

CONCLUSION

The embodiments set forth above represent the necessary information to enable those skilled in the art to practice the embodiments and illustrate the best mode of practicing the embodiments. Upon reading the following description in light of the accompanying figures, those skilled in the art will understand the concepts of the disclosure and will recognize applications of these concepts that are not particularly addressed herein. It should be understood that these concepts and applications fall within the scope of the disclosure and the accompanying claims.

The purpose of the terminology used herein is only for describing embodiments and is not intended to limit the scope of the disclosure. Where context permits, words using the singular or plural form may also include the plural or singular form, respectively. As used herein, terms such as "connected," "coupled," or the like, refer to any connection or coupling, either direct or indirect, between two or more elements.

The above description and drawings are illustrative and are not to be construed as limiting. Numerous specific details are described to provide a thorough understanding of the disclosure. However, in certain instances, well-known details are not described in order to avoid obscuring the description. Further, various modifications may be made without deviating from the scope of the embodiments.

Reference herein to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

The terms used in this specification generally have their ordinary meanings in the art, within the context of the disclosure, and in the specific context where each term is used. Certain terms that are used to describe the disclosure are discussed above, or elsewhere in the specification, to provide additional guidance to the practitioner regarding the description of the disclosure. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that the same thing can be said in more than one way.

Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any term discussed herein is illustrative only, and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given above. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions will control.

From the foregoing, it will be appreciated that specific embodiments of the invention have been described herein for purposes of illustration, but that various modifications may be made without deviating from the scope of the invention. Accordingly, the invention is not limited except as by the appended claims.

I claim:

1. A liquid soap dispenser comprising:

a base having a top surface and a raised ridge around a periphery of the top surface to form a well, wherein a portion of the top surface of the base includes a raised surface that is higher than other portions of the top surface of the base; and a socket coupled to the base, the socket configured to receive and attach to a bottle containing a liquid and having an inlet to receive the liquid from the bottle while the bottle is inverted, the socket further having an outlet to enable the liquid received from the bottle while the bottle is inverted to pass into the well, wherein the outlet is separated from the top surface by a distance greater than a height of the raised surface.

2. The liquid soap dispenser of claim 1 wherein the base further has a bottom surface, and wherein the bottom surface includes a fastener to secure the liquid soap dispenser to a surface.

3. The liquid soap dispenser of claim 2, wherein the fastener comprises a suction cup.

4. The liquid soap dispenser of claim 1, wherein the base further comprises a first portion and a second portion opposite the first portion, the first portion being coupled to the socket and the second portion being heavier than the first portion.

5. The liquid soap dispenser of claim 1, wherein the raised ridge extends above the outlet.

6. The liquid soap dispenser of claim 1, wherein the well comprises a first portion and a second portion opposite the first portion, the first portion being at least partially encompassed by a first wall of the raised ridge and the second portion being at least partially encompassed by a second wall of the raised ridge.

7. The liquid soap dispenser of claim 6, wherein the first wall comprises a first notch and the second wall comprises a second notch, the first notch and the second notch being colinear.

8. The liquid soap dispenser of claim 1, wherein the socket comprises an interlocking mechanism.

9. The liquid soap dispenser of claim 8, wherein the interlocking mechanism comprises thread.

10. A liquid soap dispenser comprising:

a rectangular base having a top surface and a raised ridge around a periphery of the top surface to form a well, wherein a portion of the top surface includes a raised surface that is higher than other portions of the top surface, wherein the well includes:

a first portion and a second portion opposite the first portion, the first portion at least partially encompassed by a first wall of the raised ridge and second end at least partially encompassed by a second wall of the raised ridge, wherein the first wall includes a first notch and the second wall includes a second notch; and a socket coupled to the rectangular base, the threaded socket configured to receive and interlock with a neck of a bottle containing a liquid, the socket having an inlet to receive the liquid from the bottle while the bottle is inverted, the socket further having an outlet to enable the liquid received from the bottle while the bottle is inverted to flow into the well, wherein the outlet is separated from the top surface by a distance greater than a height of the raised surface.

11. The liquid soap dispenser of claim 10, wherein the first notch and second notch are colinear.

12. The liquid soap dispenser of claim 10, wherein the socket is cylindrical.

13. The liquid soap dispenser of claim 12, wherein the socket further comprises a first end and a second end opposite the first end, the first end comprising a thread and having a first diameter, the second end comprising the outlet, wherein the outlet has a second diameter smaller than the first diameter.

14. The liquid soap dispenser of claim 10, wherein the rectangular base further comprises a bottom surface, and wherein bottom surface comprises a fastener to secure the liquid soap dispenser to a surface.

15. The liquid soap dispenser of claim 14, wherein the fastener comprises a suction cup.

16. A liquid soap dispenser comprising:

a rounded base having a top surface, a bottom surface opposite the top surface, and a raised ridge around a periphery of the top surface to form a well, wherein a portion of the top surface includes a raised surface that is higher than other portions of the top surface, wherein the bottom surface has a suction cup attached thereto, to secure the liquid soap dispenser to a surface, and wherein the top surface includes a raised circular surface; and a socket coupled to the base, the socket configured to receive and attach to a bottle containing a liquid and having an inlet to receive the liquid from the bottle while the bottle is inverted, the socket further having an outlet to enable the liquid received from the bottle while the bottle is inverted to flow into the well, wherein the outlet is separated from the top surface by a distance greater than a height of the raised surface.

17. The liquid soap dispenser of claim 16, wherein the well comprises:

a first portion and a second portion opposite the first portion, the first portion at least partially encompassed by a first wall of the raised ridge and second end at least partially encompassed by a second wall of the raised ridge, wherein the first wall includes a first notch and the second wall includes a second notch.

18. The liquid soap dispenser of claim 17, wherein the first notch and the second notch are colinear.

* * * * *